US005689839A

United States Patent [19]

Laganière et al.

[11] Patent Number: 5,689,839

[45] Date of Patent: Nov. 25, 1997

[54] SPLIT SIDE GUARDS

[75] Inventors: Eric Laganière, Ste-Foy; Guy Lemire, Beaumont, both of Canada

[73] Assignee: Bertec Médical Inc., Quebec, Canada

[21] Appl. No.: 699,445

[22] Filed: Aug. 19, 1996

[30] Foreign Application Priority Data

Jul. 11, 1996 [CA] Canada ..... 2181021

[51] Int. Cl.[6] ..... A47C 21/08

[52] U.S. Cl. ..... 5/425; 5/426; 5/732; 5/428

[58] Field of Search ..... 5/425, 426, 732, 5/600, 617, 427, 428, 429, 430

[56] References Cited

U.S. PATENT DOCUMENTS

| | | | |
|---|---|---|---|
| 3,930,273 | 1/1976 | Stern . | |
| 4,186,456 | 2/1980 | Huempfner . | |
| 4,509,217 | 4/1985 | Therrien . | |
| 4,612,679 | 9/1986 | Mitchell . | |
| 4,747,171 | 5/1988 | Einsele et al. . | |
| 5,084,925 | 2/1992 | Cook | 5/425 |
| 5,187,824 | 2/1993 | Stryker . | |
| 5,381,571 | 1/1995 | Gabhart . | |
| 5,384,927 | 1/1995 | Mardero et al. . | |
| 5,394,580 | 3/1995 | Foster et al. . | |
| 5,485,699 | 1/1996 | Gabhart . | |

FOREIGN PATENT DOCUMENTS

| | | | |
|---|---|---|---|
| 81302 | 12/1953 | Norway | 5/425 |

*Primary Examiner*—Steven N. Meyers
*Assistant Examiner*—Fredrick Conley
*Attorney, Agent, or Firm*—Andrus, Sceales, Starke & Sawall

[57] ABSTRACT

Provided herein are bed split side guards with adjacent units presenting at least partly curved ends so as to essentially follow a circular arc shape having its center at the pivot point of one of the sections of the bed mattress deck, thus providing a minimal spacing between the split side guard units during articulation and at any position of the mattress deck, hence preventing patient movement or entrapment through the bed side guard gaps.

5 Claims, 7 Drawing Sheets

SPLIT SIDE GUARDS

BACKGROUND OF THE INVENTION

The present invention relates to hospital bed side guards to prevent patients from falling off the bed. More specifically, the present invention relates to collapsible split side guards for adjustable beds.

Hospital beds typically include collapsible side guards of parallelogram or rectangular design, wherein the side guards are split in at least two separate portions or units generally corresponding to the length of each adjustable and articulated portion of the mattress support deck. With such configurations, a rather large gap is left between adjacent side guard units to allow articulation of the different sections of the bed mattress deck when the side guards are in the raised position. As a result, serious injuries can occur when limbs or other parts of the body of a patient enter those gaps and become entrapped or otherwise caught between adjacent side guard units.

As a result of this problem, there have been efforts to overcome the hazard with conventional bed split side guards. U.S. Pat. Nos. 5,381,571 and 5,485,699 disclose a movable protective barrier with a lock mounted on the bed guard as to maintain or close the gaps between the split side guards units.

However, closures merely unsatisfactorily reduce the potential for patient injury when the mattress deck is horizontally positioned, and they become inappropriate as the mattress deck sections are being articulated or secured at different positions. Thus, there remains a need for improvement in the safety of split side guard devices.

SUMMARY OF THE INVENTION

It is thus an object of this invention to provide split side guards which greatly reduce the hazards associated with conventional bed split side guards while allowing normal articulated functions of an adjustable hospital bed.

It is a further object of the present invention to provide a split side guard configuration having minimal spacing between adjacent split side guard units while the head section of the mattress deck is being articulated and secured at different positions.

In one embodiment, the present invention relates to a bed comprising a frame and a mattress deck including a series of sections pivotally mounted in relation with one another and support means mounted to each said sections. In the present invention, split side guards are mounted to said support means on the bed and the split side guards comprise side guard units being disposed closely adjacent to one another in generally co-planar relationship, each side guards units having opposite ends, the ends of the side guard units adjacent to another unit having at least in part a curve-like profile essentially based on a circular arc shape having its center at the pivot point of one of such sections of the mattress deck, allowing pivotal movement of the side guard units as a result of pivotal movement of said sections, without contacting one another.

Other objects and further scope of applicability of the present invention will become apparent from the detailed description given hereinafter. It should be understood, however, that this detailed description, while indicating preferred embodiments of the invention, is given by way of illustration only, since various changes and modifications within the spirit and scope of the invention will become apparent to those skilled in the art.

BRIEF DESCRIPTION OF THE DRAWINGS

Preferred embodiments of the invention are described in detail hereinafter with reference to the accompanying drawings, in which.

DETAILED DESCRIPTION

Figure 1:
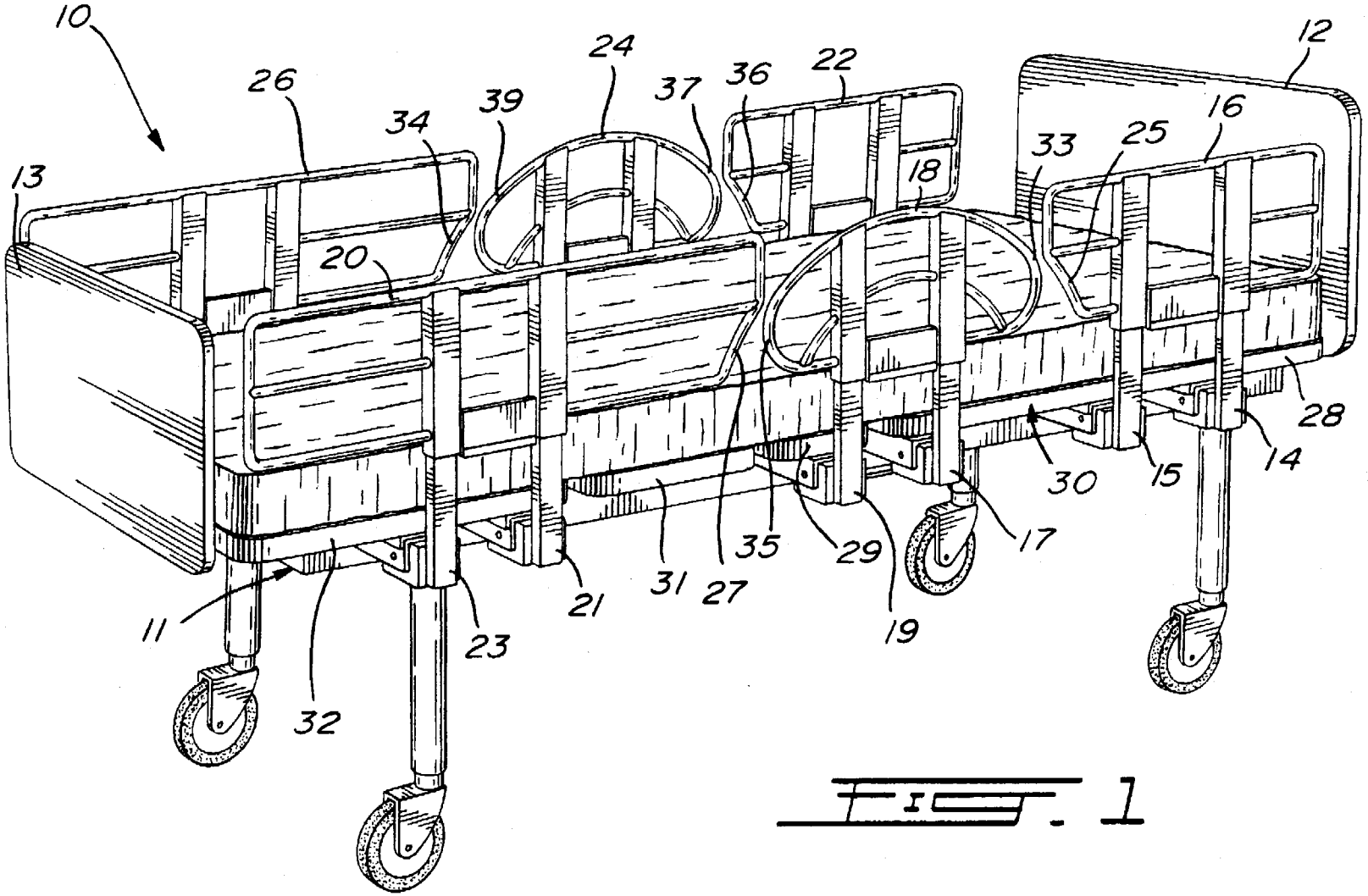
FIG. 1 is a perspective view of a hospital bed equipped with three-unit split side guards according to the present invention, showing the side guards in an elevated position.

Referring to FIG. 1, there is depicted a standard hospital bed 10 comprising a frame 11, a headboard 12, a footboard 13 and a mattress deck 30 having a series of sections 28, 29, 31, 32 pivotally mounted in relation with one another. Support means 14, 15, 21, 23 are mounted on the mattress deck sections while support means 17, 19 are fixed to the bed frame 11. Split side guard units 16, 18, 20, 22, 24, 26, constructed in accordance with the present invention, are mounted on the support means. The units 16, 18, 20, 22, 24, 26 of the split side guards have their adjacent sides 25, 33, 35, 27, 36, 37, 39, 34 generally curved as to essentially follow a circular arc shape having its center at the pivot point (not shown) of section 28 of mattress deck 30, allowing pivotal movement of the units as the mattress deck sections are being articulated. In this embodiment, units 20, 26 of the split side guards are elongated in order to cover completely the sides of the hospital bed 10.

Figure 2:
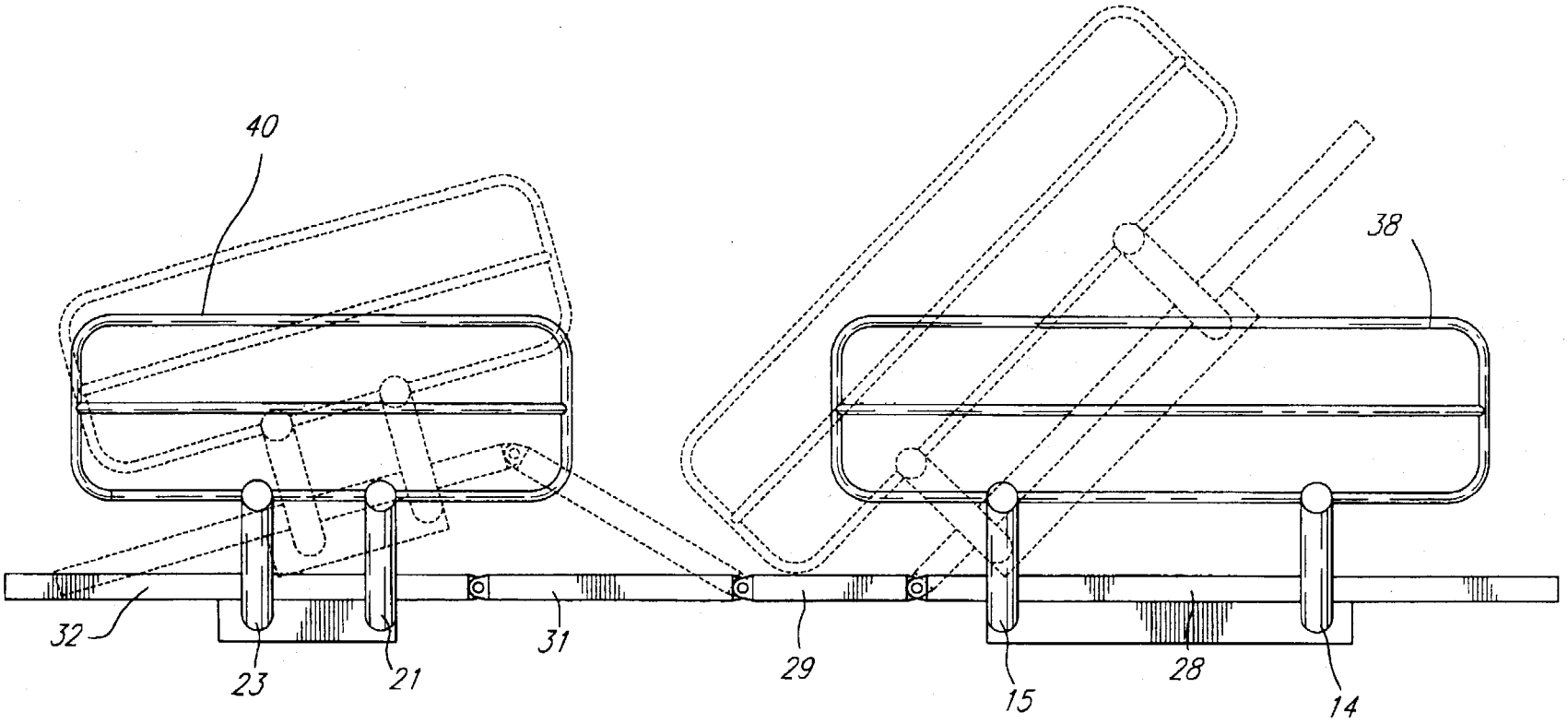
FIG. 2 (PRIOR ART)
FIG. 2 gives a side view of a conventional split side guard also illustrating the split side guard units as the bed is in its elevated position.

FIG. 2 of the drawings illustrates a conventional split side bed guard presenting a rectangular design. Large spacing between units 38 and 40 is necessary to allow movement of the units alongside the mattress deck units 28, 29, 31, 32 when the bed is articulated.

Figure 3:
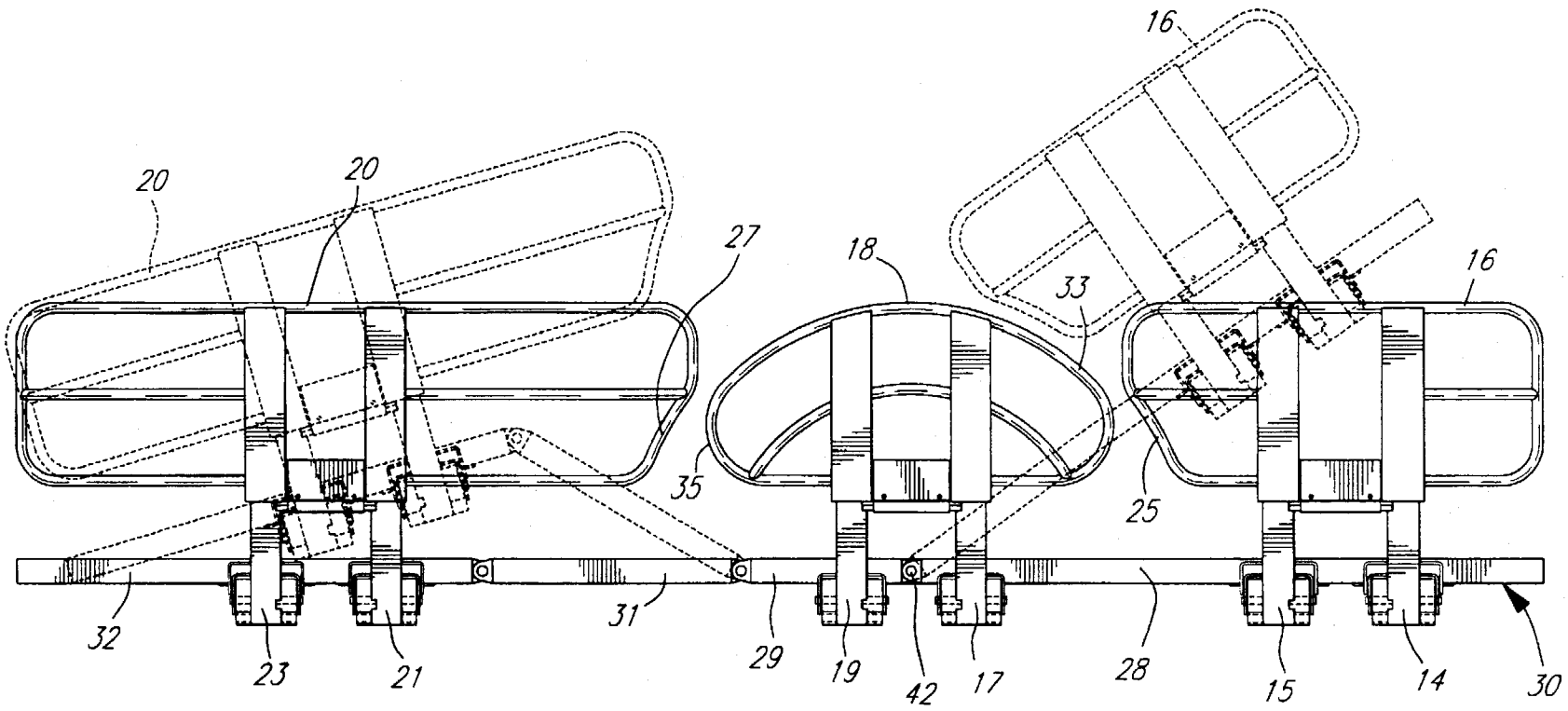
FIG. 3 is a side view of the embodiment of the present invention illustrated in FIG. 1 showing the movement of the pivotable units when the mattress deck sections are in an elevated position.

FIG. 3 gives a side view of the embodiment illustrated in FIG. 1, showing the orientation of unit 16 and unit 20 when the bed mattress deck sections 28, 29, 31, 32 are in an elevated position. A curved configuration of sides 25, 33, 35, 27 based on a circular arc shape having its center at the pivot point 42 of section 28 of mattress deck 30 allows pivotal movement of units 16 and 20 in respect with the fixed unit 18 while spacing between the units is minimal.

Figure 4:
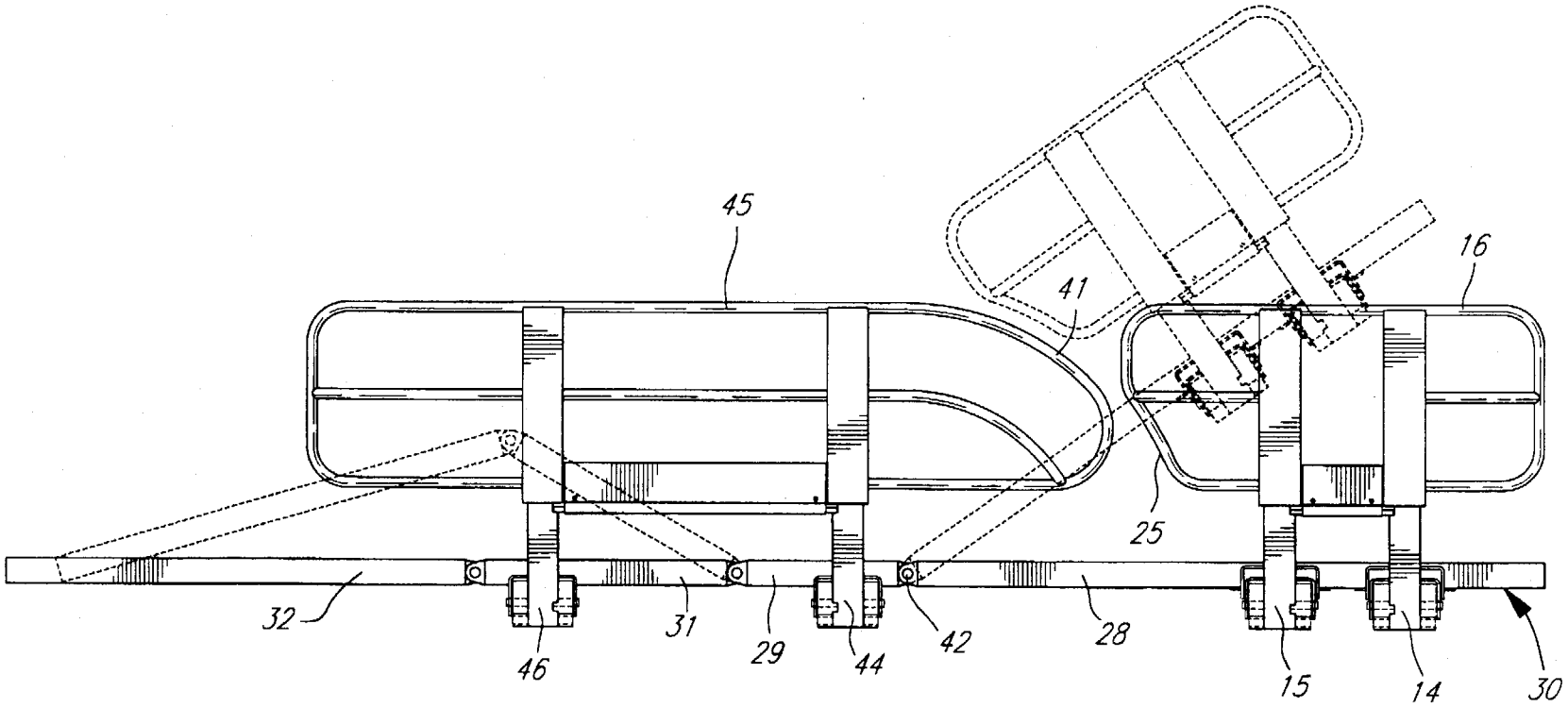
FIG. 4 gives a side view of a two-unit embodiment constructed in accordance with the present invention, showing also the pivotal movement or the head unit along with the head section of the mattress deck to which it is attached.

Another embodiment is illustrated in FIG. 4 where the split side guard comprises two units 16 and 45. The support means 14, 15, are mounted on the mattress deck sections 28, while support means 44, and 46 are fixed to the bed frame 11. In accordance with the present invention, sides 25 and 41 of units 16 and 45 have a curve-like profile based on a circular arc shape having its center at the pivot point 42 of section 28 of mattress deck 30 to allow pivotal movement of the units 16 and 45 alongside the bed mattress deck sections 28, 29, 31, 32.

Figure 5:
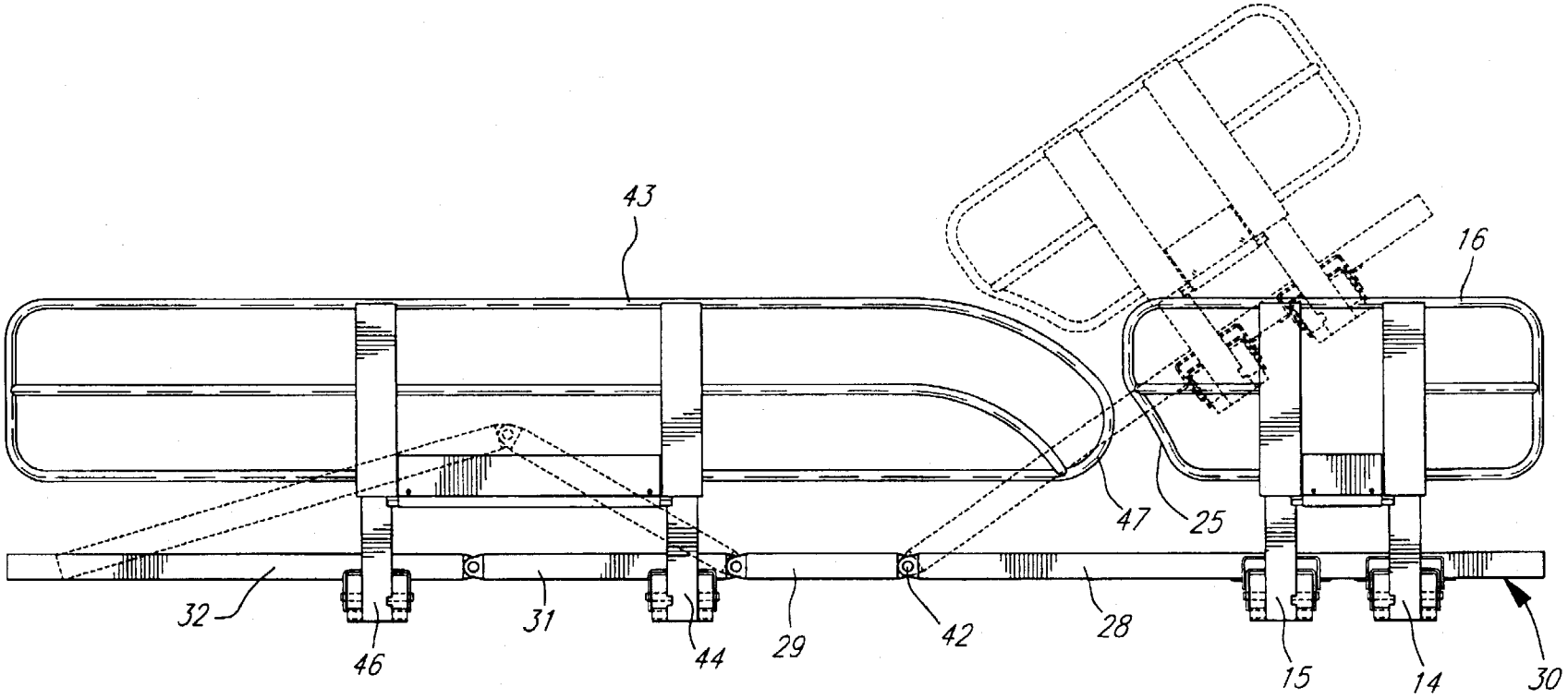
FIG. 5 is a side view of an elongated two-unit split side guard constructed in accordance with the present invention, illustrating also pivotal movement of head unit along with the head section of the mattress deck to which it is attached.

FIG. 5 shows an elongated split side guard unit 43 in another embodiment of the invention, protecting completely the bed side.

Figure 6:
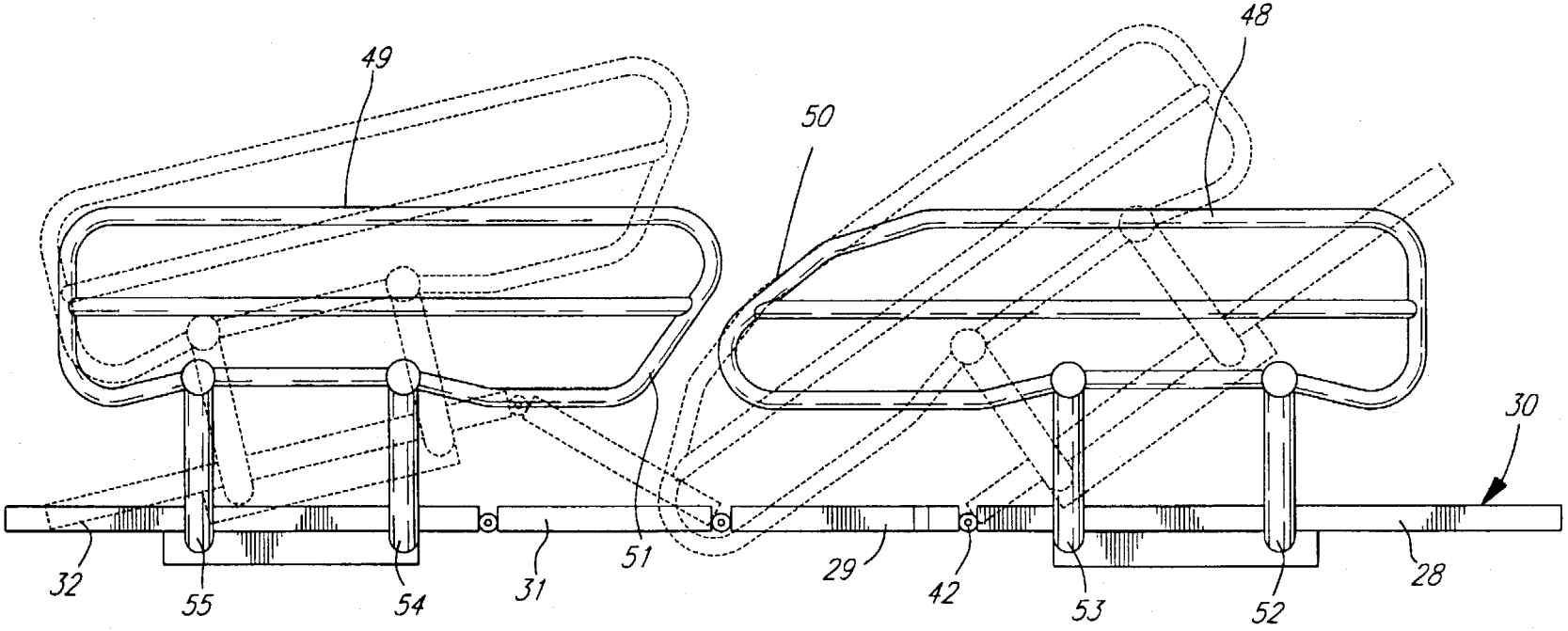
FIG. 6 is a side view of another two-unit embodiment constructed in accordance with the present invention, depicting as well movement of the bed mattress deck sections and the side guard units accordingly.

Another embodiment is shown in FIG. 6 where the split side guard comprises two units 48 and 49 of essentially similar lengths. Support means 52, 53, 54, 55 are fixed to sections 28 and 32 of the mattress deck 30. Adjacent sides 50 and 51 present a curve-like profile so as to follow a circular arc shape having its center at the pivot point 42 of section 28 of the mattress deck 30.

Figure 7:
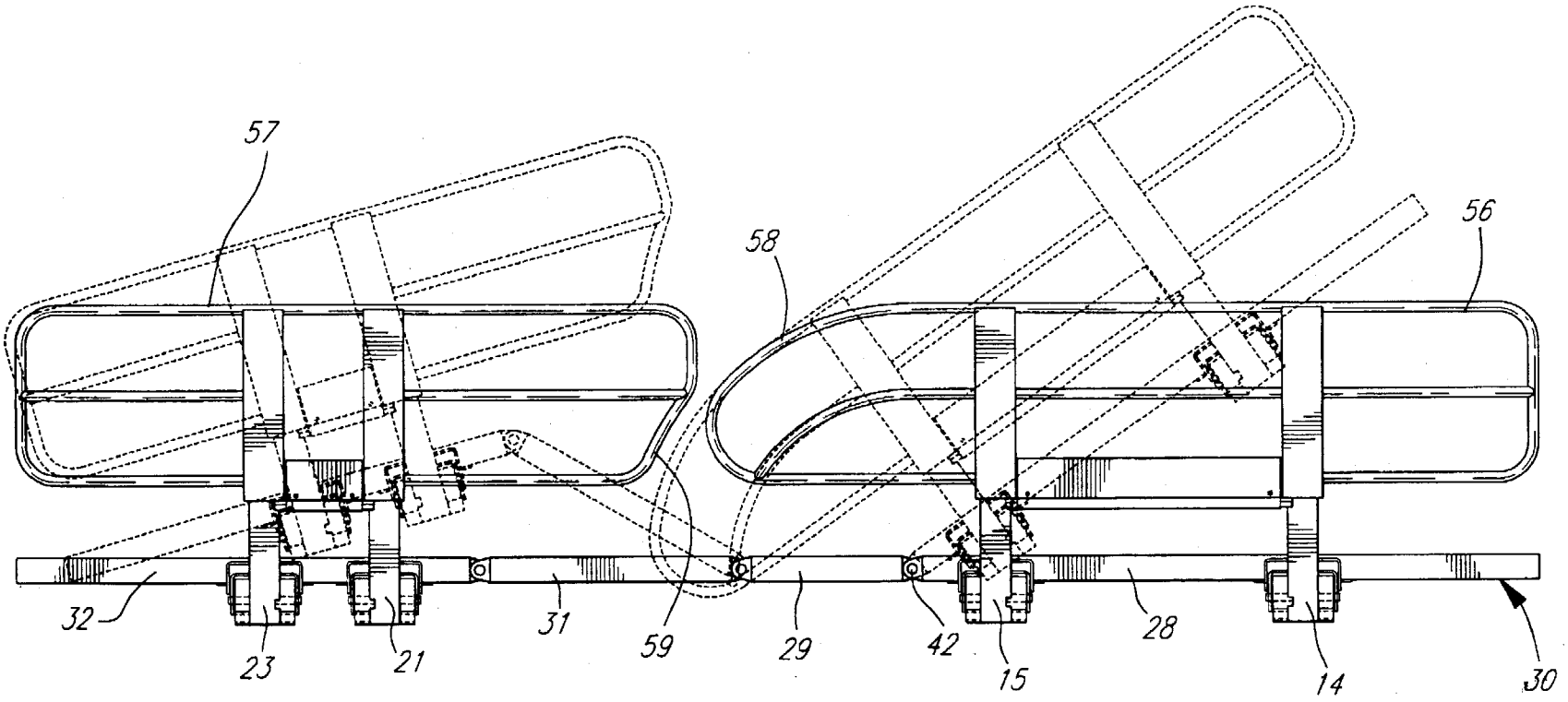
FIG. 7 is a side view of an elongated two-unit embodiment constructed in accordance with the present invention, pivotal movement of the units being also illustrated.

Finally, FIG. 7 depicts a two-unit split side guard as shown in FIG. 6, units 56 and 57 being elongated as to completely protect the bed side. Support means 14 and 15 are fixed to section 28 of the mattress deck 30, while support means 21 and 23 are fixed to section 32 of mattress deck 30. As in FIG. 6 and contrary to guards shown in FIG. 4 and FIG. 5, the guards present a gap located at the opposite side of the circular arc shape.

It is thus seen that the present invention provides a net improvement to standard hospital bed split side guards so as to eliminate the likelihood of patient entrapment through the gap existing between split side guard units. As many variations will become apparent to those skilled in the art from a reading of the foregoing disclosure, such variations are embodied within the spirit and scope of this invention as defined by the following appended claims,

What is claimed:

1. In a bed comprising a frame, a mattress deck mounted on said frame and including a series of at least two sections pivotally interconnected about a transversal pivot axis, support means mounted to each said sections, split side guards mounted to said support means, each of said split side guards comprising a series of at least two side guard units being disposed in generally co-planar relationship and mounted to the support means of the two said sections, respectively, said two side guard units having respective mutually adjacent profile portions moving along each other upon pivotal movement of at least one of said two sections of said mattress deck about the pivot axis, said two mutually adjacent profile sections being generally semicircular and centered on the pivot axis thereby allowing pivotal movement of said two side guard units as a result of pivotal movement of at least one of said two sections about the pivot axis, without contacting one another.

2. The improvement in accordance with claim 1 wherein each said split side guards is composed of two side guard units.

3. The improvement in accordance with claim 1 wherein each said split side guards is composed of three side guard units.

4. The improvement in accordance with claim 1 wherein said side guard units consist of an assembly of tubular members.

5. The improvement in accordance with claim 4 wherein said tubular members are essentially made of steel.

* * * * *